US005486644A

United States Patent [19]

Kudo et al.

[11] Patent Number: 5,486,644

[45] Date of Patent: Jan. 23, 1996

[54] ELECTRONIC MUSICAL INSTRUMENT HAVING A WAVEFORM MEMORY FOR STORING VARIABLE LENGTH WAVEFORM DATA

[75] Inventors: Masaki Kudo; Kyoko Ohno, both of Hamamatsu, Japan

[73] Assignee: Yamaha Corporation, Japan

[21] Appl. No.: 945,025

[22] Filed: Sep. 15, 1992

[30] Foreign Application Priority Data

Sep. 17, 1991 [JP] Japan ..... 3-236542

[51] Int. Cl.[6] ..... G10H 7/00

[52] U.S. Cl. ..... 811/604

[58] Field of Search ..... 84/601–607, 622, 84/627; 341/95; 364/245.1, 254.9, 715.02

[56] References Cited

U.S. PATENT DOCUMENTS

| | | | |
|---|---|---|---|
| 4,584,921 | 4/1986 | Wachi . | |
| 4,654,781 | 3/1987 | Schwartz et al. | 364/200 |
| 4,785,702 | 11/1988 | Katoh . | |
| 4,809,577 | 3/1989 | Fujita . | |
| 4,866,636 | 9/1989 | Fukami et al. | 364/514 |
| 4,975,835 | 12/1990 | Hidaka et al. | 364/200 |
| 5,081,897 | 1/1992 | Takauji | 84/604 |
| 5,347,478 | 9/1994 | Suzuki et al. | 364/715.02 |

FOREIGN PATENT DOCUMENTS

043267A2 6/1991 European Pat. Off. .

*Primary Examiner*—Jonathan Wysocki
*Assistant Examiner*—Jeffrey W. Donels
*Attorney, Agent, or Firm*—Graham & James

[57] ABSTRACT

An electronic musical instrument has a waveform memory and a tone generator. The waveform memory has a plurality of storage areas, each of which is capable of storing a fixed bit-width data. In the case where the bit-width of the waveform data corresponding to a musical tone waveform is different from the bit-width of the data which can be stored in each storage area, the whole waveform data corresponding to the musical tone waveform are stored in the waveform memory so as not to allow the generation of empty areas which store no data. The waveform data may be divided if necessary and the divided parts of the waveform data are stored in some storage areas of the waveform memory. The tone generator reads out the data corresponding to a desired musical tone which is to be generated and which are stored in the waveform memory, and determines the waveform data from the read out data based on the bit-width of the waveform data of the desired musical tone, and generates the musical tone based on the determined waveform data.

7 Claims, 8 Drawing Sheets

| | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|
| | | BS0 | 0 | | | | 1 | | | | 0 | | | | 1 | | | | | | | | | | | | | | |
| | | BS1 | 0 | | | | 0 | | | | 1 | | | | 1 | | | | | | | | | | | | | | |
| | | A0 | 0 | | | | 1 | | | | 0 | | | | 1 | | | | | | | | | | | | | | |
| | | A1 | 0 | | | | 1 | | | | 1 | | | | 0 | | | | | | | | | | | | | | |
| | | B0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 |
| | | B1 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |
| SELECT SIGNAL FOR WDSEL | | SFA | 1 | 0 | 1 | 0 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 |
| | | SFB | 1 | 1 | 0 | 0 | 0 | 0 | 1 | 1 | 1 | 0 | 1 | 0 | 0 | 1 | 1 | 0 | 1 | 0 | 0 | 1 | 1 | 0 | 1 | 0 | 0 | 1 | 1 |
| | | SFC | 0 | 0 | 0 | 0 | 0 | 0 | 0 | 0 | 1 | 1 | 1 | 1 | 1 | 1 | 1 | 1 | 0 | 0 | 0 | 0 | 0 | 0 | 0 | 0 | 0 | 0 | 0 |
| D12M='1' 12-BIT MODE | OUTPUT DATA OF WDSEL | 00 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | | 01 | D | C | B | A | G | F | E | D | F | E | D | C | G | F | E | D | E | D | C | B | E | D | C | B | E | D | C |
| | | 02 | E | D | C | B | H | G | F | E | G | F | E | D | H | G | F | E | F | E | D | C | F | E | D | C | F | E | D |
| | | 03 | F | E | D | C | I | H | G | F | H | G | F | E | I | H | G | F | G | F | E | D | G | F | E | D | G | F | E |
| D12M='0' 16-BIT MODE | | 00 | D | | | | D | | | | D | | | | D | | | | D | | | | D | | | | D | | |
| | | 01 | E | | | | E | | | | E | | | | E | | | | E | | | | E | | | | E | | |
| | | 02 | F | | | | F | | | | F | | | | F | | | | F | | | | F | | | | F | | |
| | | 03 | G | | | | G | | | | G | | | | G | | | | G | | | | G | | | | G | | |

FIG.11

ELECTRONIC MUSICAL INSTRUMENT HAVING A WAVEFORM MEMORY FOR STORING VARIABLE LENGTH WAVEFORM DATA

BACKGROUND OF THE INVENTION

The present invention relates to an electronic musical instrument employing a waveform memory and generating musical tones based on waveform data stored in the memory.

Conventional electronic musical instruments are known which employ a waveform memory storing waveform data corresponding to musical sounds of non-electronic musical instruments such as piano or organ. Waveform data of each waveform are digital data which define the amplitudes of the waveform and consist of a fixed bit-width word. The waveform memory is implemented by memory devices which have a plurality of storage areas each one capable of storing a fixed bit-width word, and which allow reading of data word-by-word. The bit-width of the memory devices is determined based on the bit-width of the waveform data to be stored. For example, when the bit-width of the waveform data is 12 bits, a memory device with an 8-bit-width, and a memory device with a 4 bit-width are employed as the waveform memory. Alternatively, three memory devices, each one of which is a 4-bit-width may also be employed as the waveform memory.

It is necessary to store waveform data corresponding to many kinds of waveforms in the waveform memory in order to implement electronic musical instruments capable of generating many kinds of musical tones having different tone colors. In considering the bit-width of the waveform data, the preferable bit-width is about 16 bits when storing the waveform data of percussive sounds such as piano sounds because the regeneration of these sounds requires a high S/N (Signal/Noise) ratio and a large dynamic range. In contrast, the regeneration of sustained sounds such as an organ sound does not require such a high S/N ratio. Therefore, it is no problem to make and store the waveform data of the sustained sounds at 12 bit-width. Thus, the preferable bit-width of the waveform data is different in accordance with the waveforms of the musical sounds. In conventional electronic musical instruments, however, all waveforms are coded into digital data having a same bit-width and the digital data are stored in the waveform memory for regeneration of musical sounds. Therefore, the following problems occur:

(1) In the case where the bit-width of the waveform data is small, the bit-width does not satisfy the requirement for the regeneration of the musical sounds which are to be regenerated at a high S/N ratio and at a high dynamic range so that the corresponding sounds cannot be regenerated at a high sound quality.

(2) Conversely, when the bit-width of the waveform data is large, although the sound quality is high, all the data including the musical sounds which do not require the regeneration at a high S/N ratio and a high dynamic range and which do not require such a large bit-width are also stored. In this case, the large storage areas are occupied by unnecessary bits, and such a wasteful use of storage areas is un-economic and is not appropriate for electronic musical instruments.

SUMMARY OF THE INVENTION

In consideration of the above, it is an object of the present invention to present an electronic musical instrument which stores waveform data in the waveform memory in such a manner that each waveform data has an optimal bit-width corresponding to the kind of the waveform and which provides a superior cost-performance ratio.

In an aspect of the present invention, there is provided an electronic musical instrument comprising:

a waveform memory for storing waveform data which are obtained by sequentially sampling musical tone waveforms, the waveform memory having a plurality of storage areas each of which is capable of storing a piece of data of a fixed bit-width, in which in the case where the bit-width of the waveform data corresponding to a musical tone waveform is different from said fixed bit-width, the whole waveform data corresponding to the musical tone waveform are stored in the waveform memory so as not to generate vacant memory areas and the waveform data may be divided if necessary and the parts of the waveform data obtained by the division are stored in a plurality of neighboring storage areas of the waveform memory; and a tone generator for reading out the data stored in the waveform memory corresponding to a desired musical tone to be generated, and for determining the waveform data from the read out data based oil the bit-width of the waveform data of the desired musical tone, and for generating the musical tone based on the determined waveform data.

Further objects and advantages of the present invention will be understood from the following description of the preferred embodiments with reference to the drawing.

BRIEF DESCRIPTION OF THE DRAWING

FIG. 11 shows the operation of word selector WDSEL.

DETAILED DESCRIPTION OF THE PREFERRED EMBODIMENTS

Figure 1:
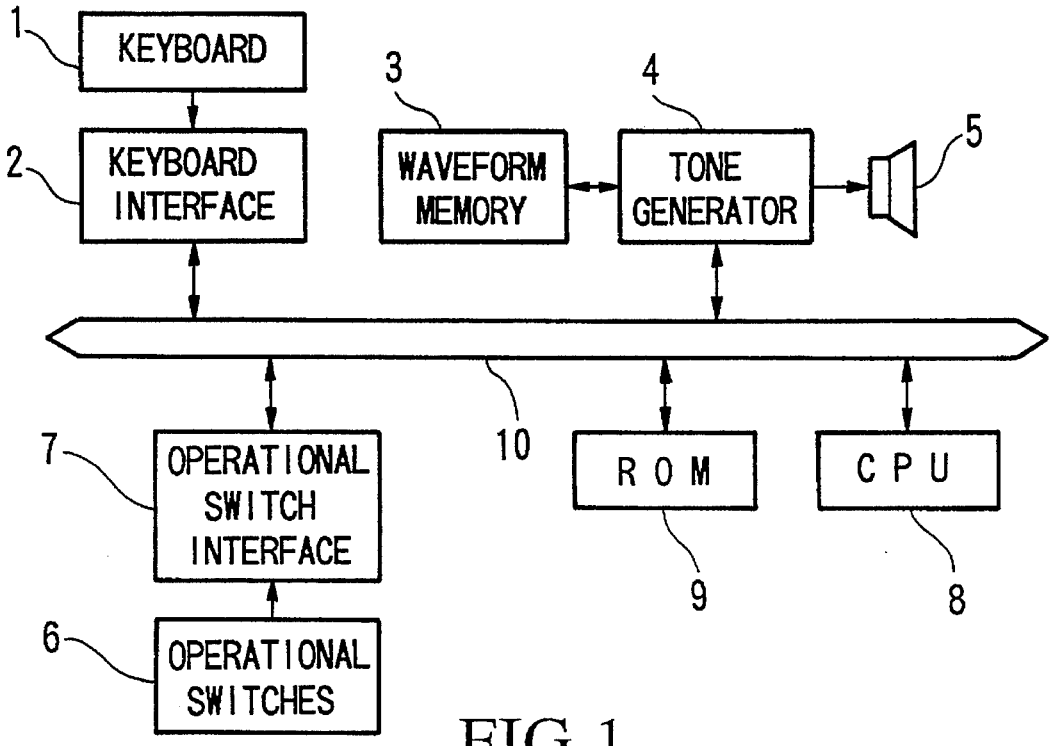
FIG. 1 is a block diagram showing the configuration of an electronic musical instrument of a preferred embodiment of the present invention.

FIG. 1 is a block diagram showing the configuration of an electronic musical instrument of a preferred embodiment of the present invention. In FIG. 1, 1 designates a keyboard which has a plurality of keys. 2 designates a keyboard interface circuit which detects the operations of keyboard 1 and which outputs the data as key operation events. 3 designates a waveform memory for storing a plurality of waveforms.

Figure 2:
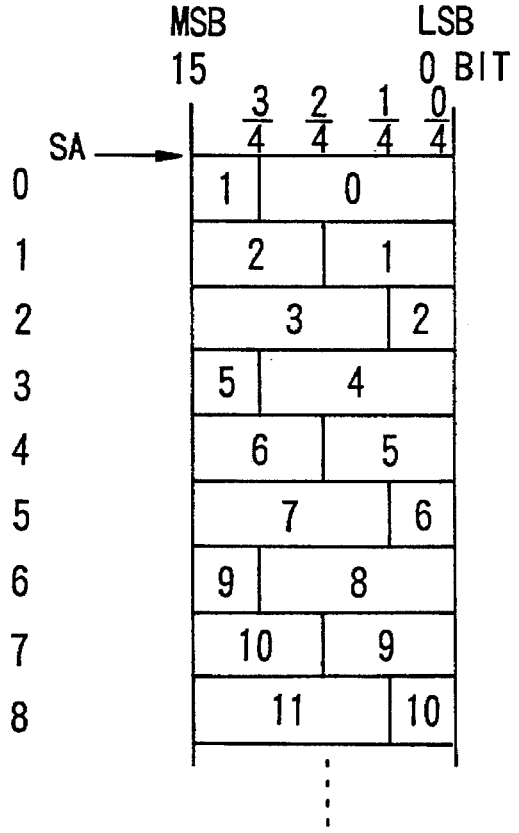
FIG. 2 shows waveform data stored in waveform memory 3 of the electronic musical instrument shown in FIG. 1.

Waveform memory 3 has a plularity of 16-bit storage areas. Waveforms to be stored in waveform memory 3 are sampled at a constant sampling period. The sampled waveforms are digitized in the form of 12 bit-width or 16 bit-width. Waveform data having 16 bit-width are stored in such a manner that a waveform datum is stored in an area of memory 3. In contrast, waveform data having 12 bit-width are stored in memory 3 in a packed manner shown in FIG. 2. FIG. 2 is a data map showing the stored format of the waveform data having a 12 bit-width. The data map is divided into a series of 16-bit length stripes arranged along a direction from up to down indicating the storage areas of waveform memory 3. Numbers [0], [1], [2], . . . are respectively arranged at the left sides of the stripes. These numbers indicate memory addresses assigned to the storage areas and corresponding to the physical addresses of the storage areas. Each memory address is a relational address which is determined with reference to the physical address of the leading storage area by assigning a [0] to the leading waveform data. In the data map, rectangles are arranged along the stripes corresponding to the storage areas. These rectangles indicate waveform data which have 12 bits. Numbers [0], [1], [2], . . . are assigned to the rectangles. These numbers correspond to the positions of the waveform data numbered from the leading waveform data.

Hereinafter, the above noted address is referred to as "waveform address" to distinguish it from the "memory address".

FIG. 2 teaches that there are relationships between the memory address and the waveform address as follows:

(1) LSB (Least Significant Bit) of a waveform data corresponding to a waveform address is stored in the memory address obtained by multiplying the waveform address with ¾.

(2) In the case where the waveform address is 4N (N=0, 1, 2, . . . ), the LSB of the corresponding waveform data is stored in the LSB storage area of the storage area having the memory address determined based on the above relationship (1).

(3) In the case where the waveform address is as 4N+1, the corresponding waveform data from LSB (the 0th bit) to the third bit are respectively stored in the bit storage areas for the 12th bit to MSB in the memory address determined based on the above relationship (1), and the waveform data from the 4th bit to MSB are respectively stored in the bit storage areas for LSB to the 7th bit in the next memory address.

(4) In the case where the waveform address is 4N+2, the corresponding waveform data from LSB to the 7th are respectively stored in the bit storage areas for the 8th bit to MSB in the memory address determined based on the above relationship (1), and the waveform data from 8th bit to MSB are respectively stored in the bit storage areas for LSB to the 3th bit in the next memory address.

(5) In the case where the waveform address is 4N+3, all the bits of the corresponding waveform data are stored in the bit storage areas for the 4th bit through MSB in the memory address determined based on the above relationship (1).

In FIG. 1, 4 designates a tone generator which generates musical sound signals based on the waveform data read out from waveform memory 3. More specifically, tone generator 4 generates musical tone signals through loop regeneration in which same waveform data corresponding to a part of waveform are cyclically read out. Such a loop regeneration technique allows a reduction in the storage capacity of waveform memory 3. The musical tone signals generated by tone generator 4 are supplied to sound system 5 and are thereby generated as musical tones. 6 designates operational switches such as tone color switches provided on a control panel (not shown), the on/off state of which are detected and output by operational switch interface circuit 7. 8 designates a CPU (Central Processing Unit) which controls the other portions of this electronic musical instrument. 9 designates ROM (Read Only Memory) which stores control programs executed by CPU 8 and control parameters used for the control. Keyboard interface circuit 2, operational switch interface circuit 7, CPU 8 and ROM 9 are connected together via data bus B and exchange data with each other.

Figure 3:
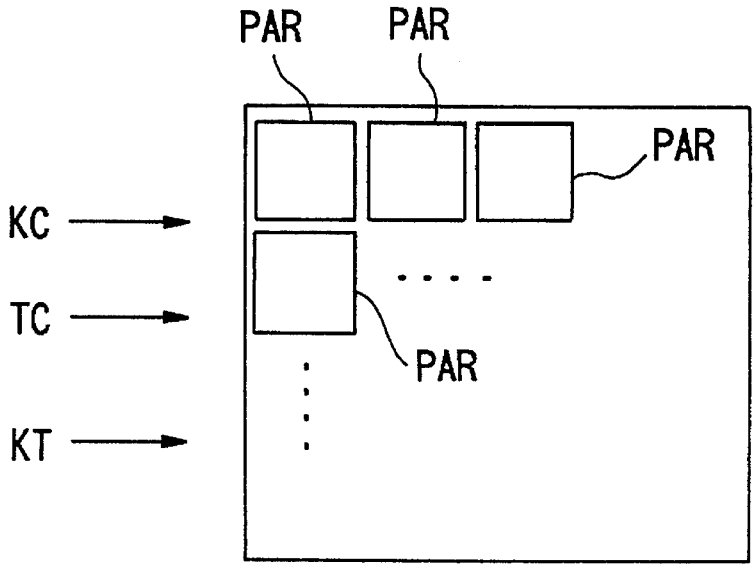
FIG. 3 shows control reading parameters stored in ROM 9 of the electronic musical instrument shown in FIG. 1.

In ROM 9, reading control parameters PARs are stored in a mapped style, such as shown in FIG. 3, and respectively correspond to the waveforms whose waveform data are stored in waveform memory 3. CPU 8 receives key-code KC representative of the depressed key and key-touch KT representative of the intensity of the key depression, which are determined through keyboard interface circuit 2, and tone color code TC, which is determined through operational switch interface circuit 2. One of the reading control parameters, corresponding to the waveform to be regenerated, is then selected and read out by CPU 8 based on the received parameters KC, KT and TC.

Figure 4:
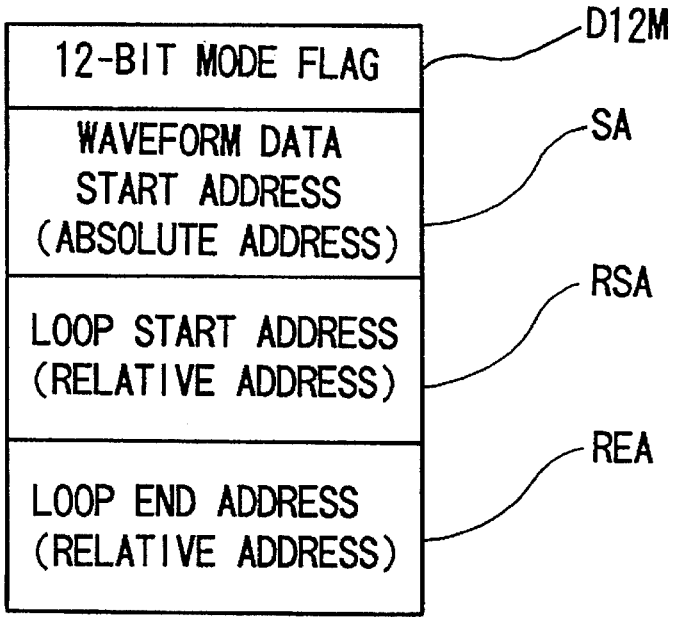
FIG. 4 shows the content of the control parameter shown in FIG. 3.

FIG. 4 shows the content of each reading control parameter PAR corresponding to a waveform. The leading parameter of reading control parameter PAR is a 12-bit mode flag D12M. The content of D12M is determined so that:

(1) if the corresponding waveform data consist of 12 bits then D12M="1", and (2) if the corresponding waveform data consist of 16 bits then D12M="0".

Waveform data start address SA is stored following the 12-bit mode flag D12M. This waveform data start address indicates the absolute address (physical address) of the leading waveform data of the corresponding waveform. Following to the waveform data start address SA, loop start address RSA and loop end address REA are sequentially stored. Loop start address RSA indicates the address of the first waveform data which is the starting position of the loop regeneration part of the waveform data. Loop end address REA indicates the address of the last waveform data which is the ending position of the loop regeneration part. When the waveform data of address REA is read out, the waveform data addressed by RSA is read out next. Loop start address RSA and loop end address REA are the relative addresses, each indicating the distances between the absolute address of the corresponding waveform data and the absolute address of the leading waveform data. i.e., SA. ROM 9 further stores the other control parameters, for example, F number table which correlates key-codes to F numbers which determine tone pitches.

Figure 5:
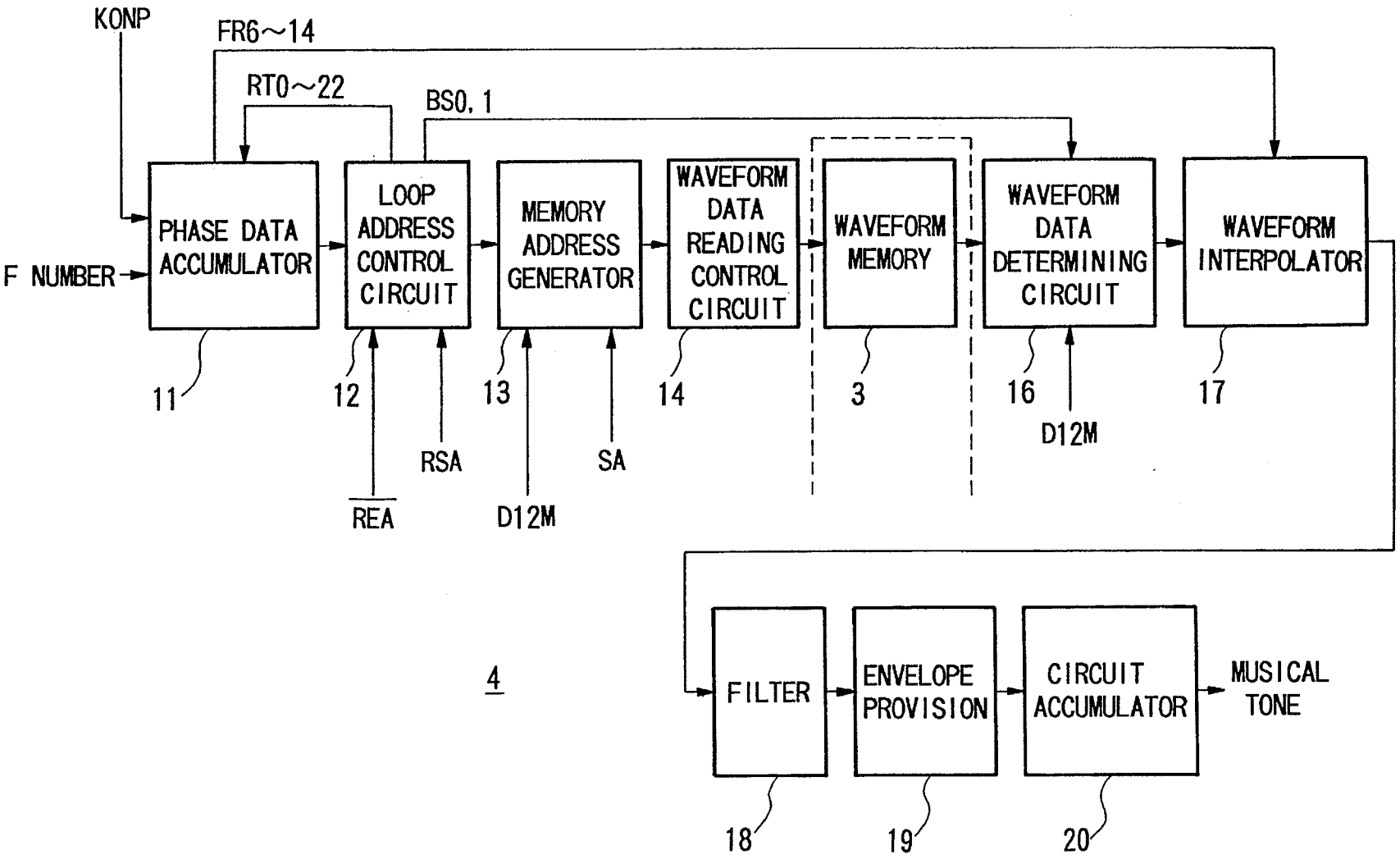
FIG. 5 is a block diagram showing the configuration of tone generator 4 of the electronic musical instrument shown in FIG. 1.

FIG. 5 is a block diagram showing the configuration of tone generator 4. In FIG. 5, waveform memory 3 is shown together with tone generator 4 in order to clarify the relationship between them. Tone generator 4 can simultaneously generate a plurality of musical tone signals using a time division control and the tone generator has the control circuit for the time division control. In this time division control, a waveform data of the generated waveform is generated in synchronization with a sampling period and the sampling period is divided into a plurality of sound channels. When a musical tone is to be generated, one of the sound channels is assigned for the tone generation by the control circuit. However, the configuration of the control circuit for assigning sound channels the same as that included in general electronic musical instruments using time division control. Therefore, schematics thereof are omitted. Tone generator 4 further has registers for storing data which are supplied by CPU 8 in order to control the musical tone generation. The schematics of these registers are also omitted.

Figure 6:
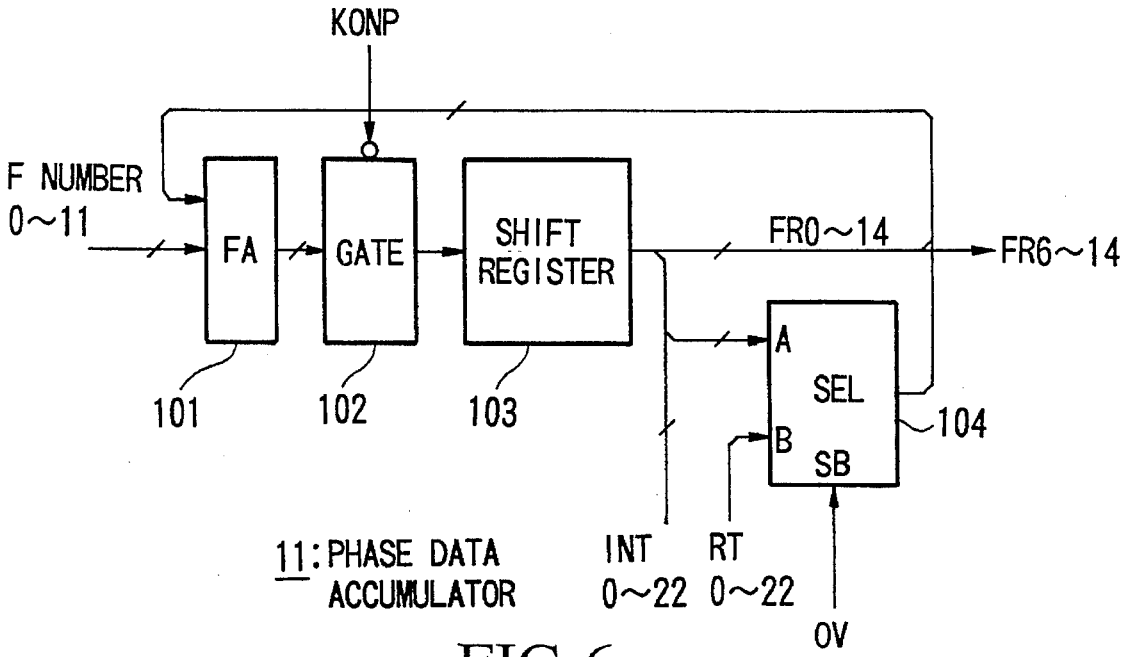
FIG. 6 is a block diagram showing the configuration of phase data accumulator 11 of tone generator 4.

In FIG. 5, phase data accumulator 11, loop address control circuit 12, memory address generator 13 and waveform data reading control circuit 14 perform an address control by which the waveform data corresponding to the key-on event determined through keyboard interface circuit 2 are sequentially read out. Waveform data determining circuit 16, waveform data interpolator 17, filter 18, envelope multiplying circuit 19 and accumulator 20 generate musical tone signals based on the read out data from waveform memory 3. The detail descriptions for these elements will follow:

Phase data accumulator 11 calculates a phase data corresponding to the phase of the waveform data to be generated. FIG. 6 shows the detailed configuration of phase data accumulator 11. In FIG. 6, full adder 101 receives the F number corresponding to the key-code of the key-depression event via first input terminal thereof. Gate 102 receives the output data of full adder 101. When key-on pulse KONP is generated in response to the key-depression, gate 102 outputs [0], whereas when key-on pulse KONP is not generated, gate 102 outputs the output data of full adder 101. Shift register 103 has a plurality of memory stages connected in a cascade manner, so as to perform tone generation by time division control, which equal the number of sound channels CH of this electronic musical instrument. The output data through the gate 102 is shifted through the stages of shift register 103 in synchronization with a clock generated by a predetermined period and is output as phase data from the shift register when one cycle of the sampling period elapses after the data is input to the shift register. The phase data consists of integer portion INT constituted by 23 bits and of fractional portion FR constituted by 15 bits. Selector 104 has data input ports A and B and a select signal input terminal. Integral portion INT of the phase data is input to data input port A and waveform address RT (integer data) generated by loop address control circuit 12 is input to data input port B. Overflow flag OV, which will be described later, is input to the select signal input terminal of selector 104. When overflow flag OV is "0", selector 104 selects and outputs data INT entered via data input port A, whereas when overflow flag OV is "1", selector selects and outputs data RT entered via data input port B. The output data of selector 104 and fractional portion FR of the phase data constitute a real number data. This real number data is supplied to the second input terminal of full adder 101 and is added with the input data of the first input terminal.

Figure 7:
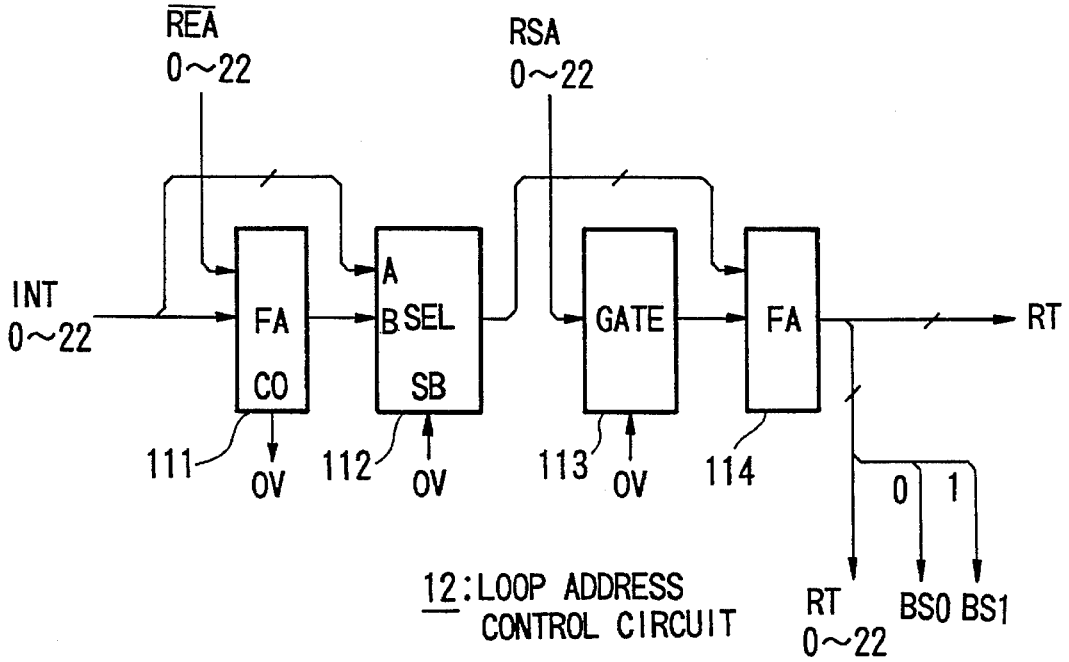
FIG. 7 is a block diagram showing the configuration of loop address control circuit 12 of tone generator 4.

Loop address control circuit 12 receives integer portion INT of the phase data generated by phase data accumulator 11, loop start address RSA which are stored in a register (not shown) by CPU 8, and the inverted loop end address which is obtained by inverting all the bits of loop end address RSA in such a manner that "0" is inverted to "1" and "1" is inverted to "0". Loop address control circuit 12 modifies integer portion INT of the phase data as necessary, and outputs the integer portion or the modified integer portion as waveform address RT described above. Furthermore, loop address control circuit 12 performs other operations relating to the loop-back control for the loop regeneration such as the generation of overflow flag OV. FIG. 7 is a block diagram showing the detailed configuration of loop address control circuit 12. Full adder 111 adds integer portion INT with the inverted loop address. i.e., the data which defines (-REA-1) by 2's complement form. When integer portion INT of the phase data indicates The addresses which are prior to loop end address REA, overflow does not occur in the addition by full adder 111 so that "0" is output as overflow flag OV. When integer portion INT of the phase data becomes more than loop end address REA, overflow occurs in the addition by full adder 111 so that "1" is output as overflow flag OV. Overflow flag OV is supplied to selector 112 as the select signal. When overflow flag OV is "0", selector 112 selects and outputs integer portion INT of the phase data, whereas when overflow flag OV is "1", selector 112 selects and outputs data (INT-REA-1) output by full adder 111. Overflow flag OV is further supplied to gate 113 as the gate control signal. When overflow flag OV is "1", gate 113 outputs loop start address RSA, whereas when overflow flag OV is "0", gate 113 outputs "0". Full adder 114 adds the output data of selector 12 with the output data of gate 113. The added result of full adder 114 is fed back to selector 104 of phase data accumulator 11 as waveform address RT. The lower 2 bits of waveform address RT are supplied to waveform data determining circuit 16 as waveform data phase signals BS0 and BS1. These waveform data phase signals are the residual which is generated by dividing waveform address RT by four and are used by waveform data determining circuit 16 as the select signals for selecting waveform data from the read out data of waveform memory 3.

Figure 8:
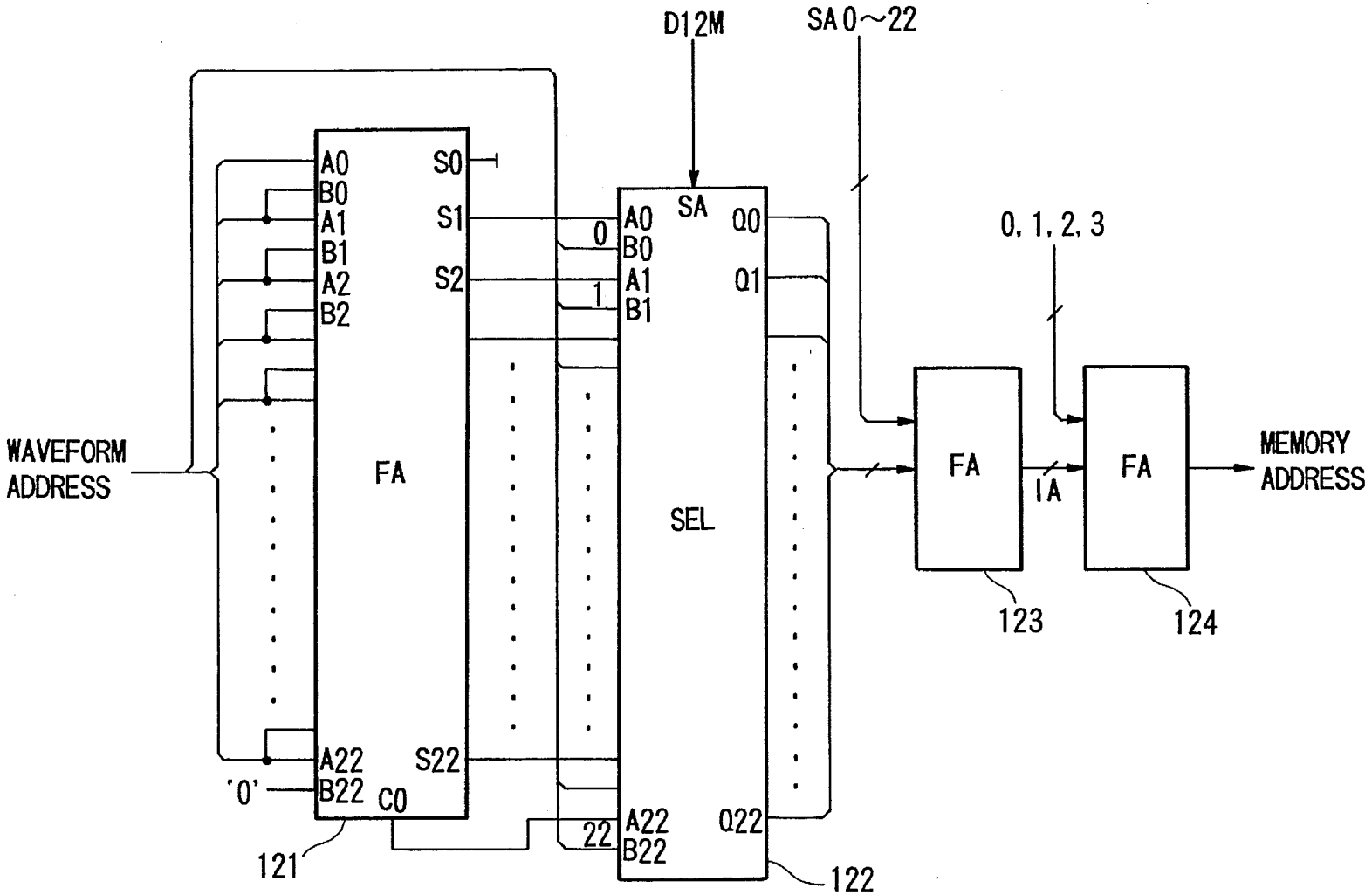
FIG. 8 is a block diagram showing the configuration of memory address generator 13 of tone generator 4.

Memory address control circuit 13 generates the memory address of the waveform data to be read out from waveform memory 3, based on the corrected waveform address RT outputted from loop address control circuit 12. FIG. 8 shows the detailed configuration of memory address control circuit 13. Full adder 121 his input terminals A0 through A22 capable of receiving 23 bits data (herein, A0 corresponds to LSB and A22 corresponds to MSB, i.e., the number following each alphabet indicates the order of the bit), input terminals B0 through B22 capable of receiving 23 bits data, output terminals S0 through S22 and carry-out output terminal CO. Input terminals A0 through A22 of full adder 121 respectively receive 23 bits constituting the waveform address which is output from loop address control circuit 12. Input terminals B0 through B21 of full adder 121 respectively receive the upper 22 bits included in waveform address RT or the corrected waveform address output from loop address control circuit 12. Input terminal B22 of full adder 121 is fixed at "0". That is to say, data RT/2 is input to full adder 121 via input terminals B0 through B22. Full adder 121 outputs (RT+RT/2)/2=(¾)RT to selector 122 via output terminal S1 through S22 and carry-out output terminal CO. This output data indicates the memory address corresponding to the waveform address in the case where the bit-width of the waveform data is 12 bits. Output terminal S0 of full adder 121 is floating, i.e., LSB of the added result is not used. Selector 122 receives 12-bit mode flag D12M as the select signal. When D12M="1", selector 122 selects and outputs data (¾)RT supplied from full adder 121, whereas when D12M="0", selector 122 selects and outputs waveform address RT. Full adder 123 adds the output data of selector 122 with start address SA and outputs the added result as reference address IA. Full adder 124 sequentially calculates IA+0, IA+1, IA+2 and IA+every sound channels. These added results are supplied to waveform data reading control circuit 14 as the read out addresses. As a result, four data corresponding to the read out addresses are sequentially read out from waveform memory 3.

Figure 9:
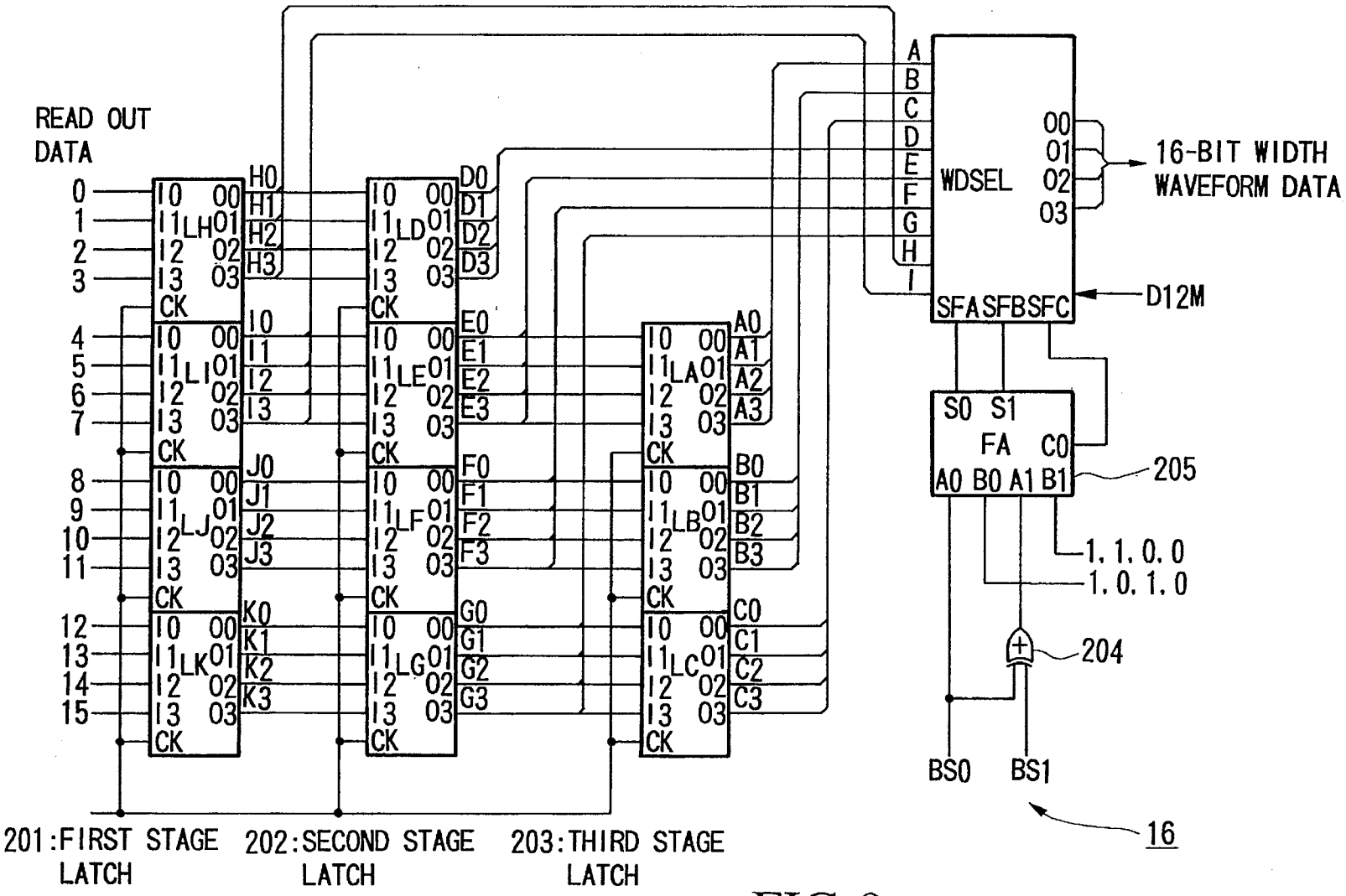
FIG. 9 is a block diagram showing the configuration of waveform data determining circuit 16 of tone generator 4.

Waveform data determining circuit 16 four waveform data from four read out data of waveform memory 3, each one is a 16-bit width, based on 12-bit mode flag D12M. FIG. 9 shows the detail description of waveform data determining circuit 16. First stage latch 201 is a 16-bit latch consisting of four 4-bit latches LH, LI, LJ and LK. Latches LH, LI, LJ and LK respectively receive LSB (the 0th bit) through the third bit, the 4th bit through the 7th bit, the 8th bit through the 11th bit and the 12th bit through MSB (the 15th bit) of the read out data of waveform memory 3 and hold and output the received data therein by clock CK. Second stage latch 202 is a 16-bit latch consisting of 4-bit latches LD, LE, LF and LG. Latches LD, LE, LF and LG respectively receive the output data of latches LH, LI, LJ and LK which constitute the first stage latch 201 and hold and output the received data therein by clock CK. Third stage latch 203 is a 12-bit latch consisting of three 4-bit latches LA, LB and LC. Latches LA, LB and LC respectively receive the output data of latches LE, LF and LG, i.e., the upper 12 bits of the data stored in the second stage latch 202, and hold and output the received data therein by clock CK. Exclusive OR gate 204 calculates the exclusive OR of BS0 and BS1 which are the lower 2 bits of waveform address RT. Full adder 205 has input terminals A1 and A0 for a first input data, input terminals B1 and B0 for a second input data, and output terminals S1 and S0 and carry-out output terminals CO for outputting the result of adding the first and second input data. Input terminals A1 and A0 of full adder 205 respectively receive the output data of exclusive OR gate 204 and waveform data phase signal BS0. Input terminals B1 and B0 of full adder 205 sequentially receive (1, 1), (1, 0), (0, 1) and (0, 0) during the interval corresponding to one sampling period. Word selector WDSEL has eight input ports A through I, each one capable of inputting 4 bits and select signal input terminals SFA, SFB and SFC. Input ports A, B and C respectively receive the output data of latches LA, LB and LC of the third stage latch. Input ports D, E, F and G respectively receive the output data of latches LD, LE, LF and LG of the second stage latch. Input ports H and I respectively receive the output data of latches LH and LI of the first stage latch. Select signal input terminals SFA, SFB and SFC respectively receive the 0th and 1st bits of the added result S0 and S1 and carry-out data CO output by full adder 205. Word selector WDSEL further receives 12-bit mode flag D12M. Word selector WDSEL generates waveform data based on the above received data.

Figure 10:
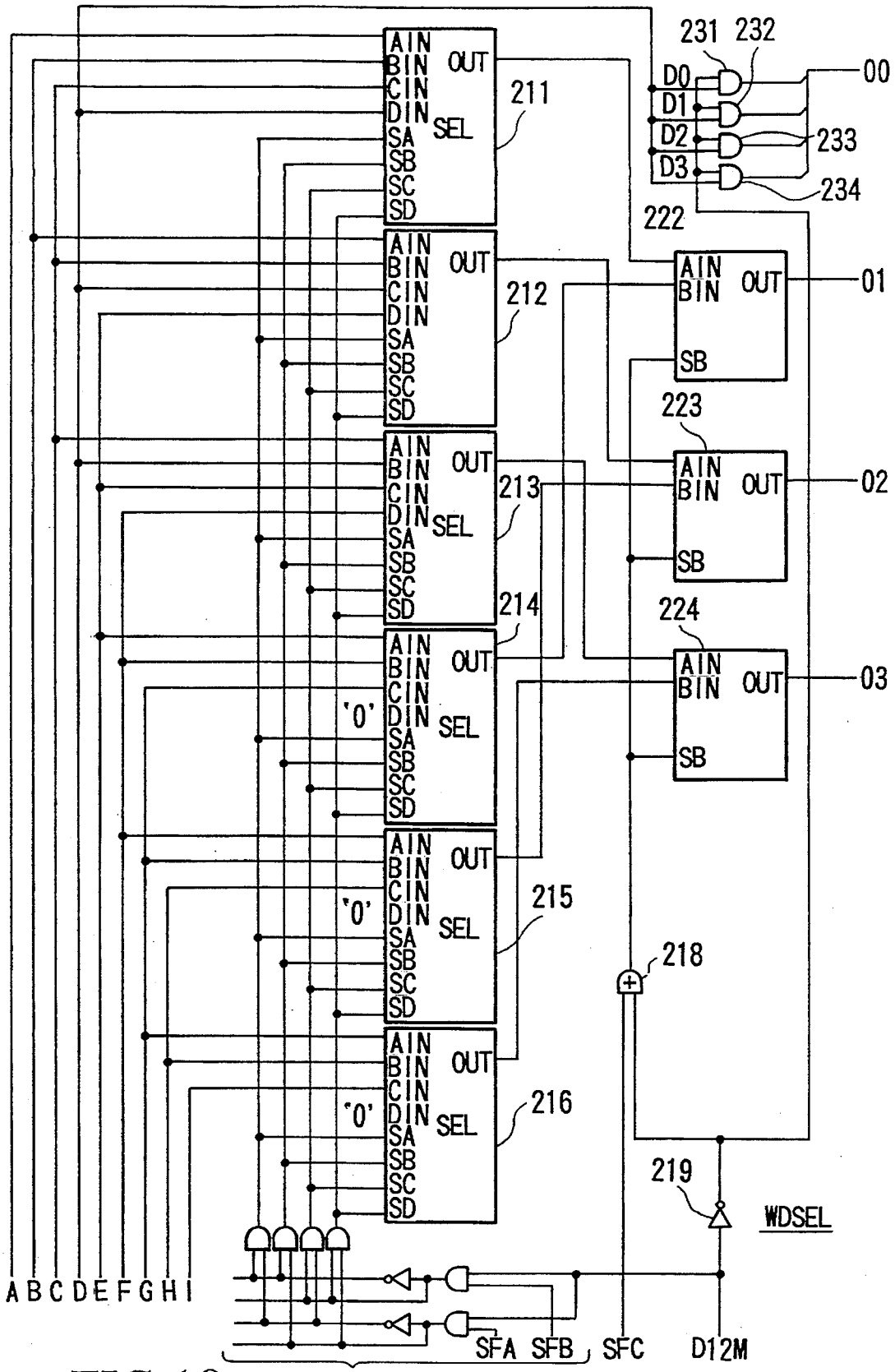
FIG. 10 is a block diagram showing the configuration of word selector WDSEL employed in waveform data determining circuit 16.

FIG. 10 shows the detail configuration of word selector WDSEL. Selectors 21i through 216 have four input ports AIN, BIN, CIN and DIN, each one capable of inputting 4 bits, and four select signal input terminals SA, SB, SC and SD respectively corresponding to inputs port AIN, BIN, CIN and DIN. Input ports of these selector 211 through 216 are connected to input ports A through I as illustrated in FIG. 10. Selectors 214 through 216 receive [0] at their input ports DIN. Each selector selects and outputs the input data of AIN if SA="1", the input data of BIN if SB="1", the input data of CIN if SC="1" or the input data of DIN if SD="1".

Decoder 217 outputs data (1, 0, 0, 0) respectively to select signal input terminals SA, SB, SC and SD of each selector 211 to 216 when 12-bit mode flag D12M is "0". In contrast, when 12-bit mode flag D12M is "1", decoder 217 decodes 2-bit data supplied via select signal input terminals SFA and SFB, and outputs 4-bit data obtained by the decoding to select input signals SA, SB, SC and SD of each selector 211 to 216.

OR gate 218 receives the input data via select signal input terminal SFC and the output data of inverter 219 which inverts 12-bit mode flag D12M. Selectors 222 through 224 have input ports AIN and BIN, each one capable of inputting 4 bits. The input ports AIN of selectors 222 through 224 respectively receive the output data of selectors 211 through 213. The input ports BIN of selectors 222 through 224 respectively receive the output data of selectors 214 through 216. When the output data of OR gate 218 is "0", each one of selectors 222 through 224 selects and outputs the input data of input port A thereof, whereas when the output data of 0R gate 218 is "1", each selector selects and outputs the input data of input port B thereof. The input data for these selectors consist of 4 bits. Thus, the output data 01 through 03 of these selectors consist of 4 bits. AND gates 231 through 234 calculate AND operation using the corresponding bit of the 4 bit input data received via input port D and the output data of inverter 219. AND gates 231 through 234 then output the results as 4-bit data 00. The data 00 through 03 thus obtained constitute 16-bit data. The 16-bit data is supplied to waveform interpolator 17 shown in FIG. 5 as 16-bit waveform data.

Four waveform data are supplied to interpolator 17 from waveform determining circuit 16 during a time interval corresponding to one sound channel. Interpolator 17 interpolates these waveform data over time by the third order interpolation based on the upper 9 bits of the fractional portion FR of the phase data generated by phase data accumulator 11 and outputs the interpolated waveform data. The output waveform data of interpolator 17 are supplied to filter 18 and therein receive the filtering operation corresponding to the musical parameters such as tone color assigned to the sound channel of the waveform data. The output waveform data of filter 18 are then supplied to envelope provision circuit 19 and thereby provided with the envelopes. Accumulator 20 accumulates the waveform data corresponding to all the sound channels output from envelope provision circuit 19 during one cycle of the sampling period and supplies the accumulated waveform data to sound system 5 shown in FIG. 1 to generate musical tones.

The operation of this electronic musical instrument will be described.

[A] Regeneration of 16 bit-width waveform data

When any key of keyboard 1 is depressed and the key-on event is determined by CPU 8 via keyboard interface circuit 2, the sound channel for generating the musical tone corresponding to the depressed key is determined by CPU 8. CPU 8 then reads out the F number corresponding to the key-code of the key-on event from F number table stored in ROM 9 and writes the F number in the register provided in tone generator 4. Thereafter, the F number stored in the register is repeatedly read out and supplied to full adder 101 in synchronization with the sound channel as determined above. The musical tone waveform to be regenerated is determined by CPU 8 based on the designated tone color and key-touch of the key-on event. 12-bit mode flag D12M (in this case, D12M="0"), start address SA, loop start address RSA and loop end address REA from ROM 9, all of which correspond to the determined musical tone waveform, are then read out from ROM 9 and the read out data are written in the corresponding registers provided in tone generator 4 by CPU 8. Thereafter, these stored data are repeatedly read out and supplied to the corresponding parts of the tone generator in synchronization with the sound channel assigned for the tone generation corresponding to the key-on event.

During the period corresponding to the assigned sound channel in the first sampling period after the detection of the key-on event, key-on pulse KONP whose level is "1", is generated and supplied to gate 102 of phase data accumulator 11 in tone generator 4. As a result, data [0] is output from gate 102 and is written in shift register 103 as the initial value of the phase data corresponding to the sound channel. The initial data [0] of the phase data thus written is output from shift register 103 when one sampling period is lapsed from the write timing. Integral portion INT of the output phase data of shift register 103 is supplied to full adder 111 of loop address control circuit 12 and thereby added with -REA-1.

When integer portion INT of the phase data is less than loop end address REA, both selector 104 of phase data accumulator 11 and selector 112 of loop address control circuit 12 select integer portion INT of the phase data (in this case, INT=[0]) output from shift register 103 because full adder 111 outputs "0" as overflow flag OV.

In phase accumulator 11, integer portion INT of the phase data is fed back to full adder 101 via selector 104 and fractional portion RT thereof is directly fed back to full adder 101. The phase data thus fed back is then added with the F number by adder 101. The added result of full adder 101 passes through gate 102 and is written in shift register 103 because the first sampling period after the detection of the key-on event has already ended and key-on pulse KONP is not activated at this time. The phase data thus written is output from shift register 103 and added again with the F number by full adder 101 when one sampling period has been lapsed. Thereafter, the F number is accumulated and the accumulated data is output as the updated phase data in synchronization with the sampling period.

When integer portion INT of the phase data is less than loop end address REA, integer portion INT passes through selector 112 and full adder 114 of loop address control circuit 12 and is output as waveform address RT.

In memory address generating circuit 13, waveform address RT outputted from loop address control circuit 12 is selected and outputted by selector 122 because the content of 12-bit mode flag D12M is "0". Waveform address RT selected by selector 22 is added with start address SA by full adder 123. As a result, reference address (physical address) IA corresponding to the waveform to be generated is obtained from full adder 123. During the sound channel, the additions IA+[0], IA+[1], IA+[2] and IA+[3] are sequentially executed by full adder 123 and the four addresses obtained by the additions are sequentially supplied to memory reading control circuit 14. As a result, four data corresponding to these addresses are read out from waveform memory 3 and are sequentially supplied to waveform data determining circuit 16.

In waveform data determining circuit 16, the read out data from waveform memory 3 are stored in the first stage latch 201 at first, after which, the stored data are sequentially shifted through the second stage latch 202 and the third stage latch 203. Input data for input terminals B0 and B1 of full adder 205 are switched in synchronization with the input and shift operation of latches 201 through 203. More specifically, when the read out data corresponding to address IA+[0] is written in the second stage latch 202, data [1, 1] are respectively supplied to input terminals B1 and B0, and when the read out data corresponding to address IA+[1] is written in the latch, data [1, 0] are supplied, and when the read out data corresponding to address IA+[2] is written in the latch, data [0, 1] are supplied, and when the read out data corresponding to address IA+[3] is written in the latch, data [0, 0] are supplied.

In word selector WDSEL, when the content of 12-bit mode flag D12M is "0", "1" is supplied to select input terminal SA of each one of selectors 211 through 216 and "0"s are supplied to the other select input terminals SB through SD of the selectors. As a results, each selector selects the input data of input port AIN thereof. Furthermore, in the same case, "0" is supplied to select input terminal SB of each one of selectors 222 through 224. As a result, selectors 222 through 224 select the input data of input ports BIN thereof and the selected data are output as output data 01 through 03 consisting of the third bit through the 15th bit of the waveform data. Input data via input port D pass through AND gate 231 through 234 and are output as output data 00 consisting of the 0th bit through the third bit of the waveform data. In the case where D12M="0", the input select signals supplied to input terminals SFA, SFB and SFC of word selector WDSEL are not used for the selection of the data stored in the latches, and the data stored in four latches D, E, F and G of the second stage latch 202 are output from waveform data determining circuit 16 as output data 00 through 03 consisting of 16 bits as shown in FIG. 11. Four waveform data are sequentially output from waveform determining circuit according to the above manner during one sound channel and the four waveform data are supplied to interpolator 17. Interpolator 17 then executes the interpolation using the four supplied waveform data and the fractional portion of the phase data and outputs the interpolated waveform data. Filter 18 carries out the filtering operation on the interpolated waveform data. The output data of filter 18 is multiplied with envelope by envelope multiplication circuit 19. The output data of envelope multiplication circuit 19 are accumulated in accumulator 20 and the accumulated data, each of which is the sum of the waveform data of the sound channels included in the sampling period, are output from accumulator 20 by sampling period. The output data of accumulator 20 are supplied to sound system 5.

When the phase data output from phase data accumulator 11 increase so that the integer portion INT of the phase data equals loop end address REA, overflow flag OV is changed to "1". As a result, in loop address control circuit 12, the data INT-REA-1 output from full adder 111 is selected by selector 112 and the selected data is supplied to full adder 114. Furthermore, gate 113 is opened and loop start address RSA is thereby supplied to full adder 114. Therefore, the calculation INT-REA-1+RSA is executed by full adder 114. In this manner, the address corresponding to the sum of the excess part of the integer portion INT of the phase data which exceeds loop end address REA and loop start address RSA is output from full adder 114 as waveform address RT. In phase data accumulator 11, waveform address RT is selected by selector 104 because overflow flag OV is "1". The selected waveform address RT and the fractional portion FR of the phase data are fed back to full adder 104 and are thereby added with F number. The added result of full adder 101 is written in shift register 103 via gate 102. The data written in the shift register is read out therefrom after one sampling period has been lapsed. At this time, the address read out from shift register 103 is the address in the vicinity of loop start address RSA. As a result, overflow flag OV which full adder 111 outputs is returned to "0". Thereafter, the update of the waveform address is repeatedly executed by accumulating the F number as described above and the waveform data are sequentially regenerated based the waveform address until the integer portion INT of the phase data reach at the loop end address REA.

[B] Regeneration of 12 bit-width waveform data

Next, the description will be given with respect to the regeneration of 12 bit-width waveform data. There is no difference between the operations of phase data accumulator 11 and loop address control circuit 12 for regenerating 12 bit-width waveform data and the operations of those for regenerating 16 bit-width waveform data. The description for the operations of phase data accumulator 11 and loop address control circuit 12 is omitted to avoid duplication. In the case where the waveform data to be regenerated is 12 bit-width, "1" is set in the register of tone generator 4 as 12-bit mode flag D12M. As a result, in memory address control circuit 13, selector 122 selects and outputs the memory address (¾)RT (relational address) which corresponds to 12 bit-width waveform data and is output from full adder 121. Address (¾)RT and start address SA (absolute address) are added by full adder 123 and the added result is output as reference address IA. The additions IA+[0], IA+[1], IA+[2] and IA+[3] are sequentially executed by full adder 123 and the four added results are sequentially supplied to memory reading control circuit 14. As a result, four waveform data corresponding to tile four addresses thus supplied are read out from waveform memory 3 and are sequentially supplied to waveform determining circuit 16.

The read out data of waveform memory 3 are sequentially shifted through the first stage latch 201, the second stage latch 202 and the third stage latch 203. The data stored in each one of these latches are supplied to word selector WDSEL. In this case, in the output data 00 through 03 of word selector WDSEL, each one consisting of 4 bits, the content of the data 00 corresponding to the lowest 4 bits is all "0" because D12M="1" (see FIG. 11). The data stored in latches 201 through 203 are selected and arranged to form 12 bit-width waveform data and the waveform data is output as the upper 12 bits output data 01 through 03 of word selector WDSEL as follows:

(1) The case where waveform address RT is defined as 4(N−1)

In this case, "0"s are supplied to the input terminals A0 and A1 of full adder 205 because (BS1, BS0)=(0, 0) as shown in FIG. 11. When the waveform data corresponding to waveform address RT are read out and are written in the second stage latch, data (1, 1) are respectively supplied to the input terminals B1 and B0 of full adder 205 and select signals (SFA, SFB, SFC)=(1, 1, 0) are supplied to word selector WDSEL. As a result, the input data of input port D, E and F, which are the stored data of latches LD, LE and LF, are output as the output data 01, 02 and 03, as shown in FIG. 11. It will be clearly understood that the data stored in these latches constitute the waveform data corresponding to the waveform address defined as 4(N−1), based on the previously described relationship between the waveform address and the memory address.

Next, when clock CK is generated, the stored data of the second stage latch 202 are shifted to the third stage latch 203 and the stored data of the first stage latch 201 are shifted to the second stage latch 202 and new read out data from waveform memory 3 is written in the first stage latch 201. Data (1, 0) are respectively supplied to the input terminals B1 and B0 of full adder 205 and select signals (SFA, SFB, SFC)=(0, 1, 0) are supplied to word selector WDSEL. As a result, the input data of input port C, D and E, which are the stored data of latches LC, LD and LE, are output as the output data 01, 02 and 03, as shown in FIG. 11. These data correspond to the data which have ever been stored in latches LG, LH and LI before the clock is generated, i.e., the waveform data corresponding to waveform address RT+1.

Next, the shift operation of the first through third latches is executed by clock CK again, after which, data (0, 1) are respectively supplied to the input terminals B1 and B0 of full adder 205 and select signals (SFA, SFB, SFC)=(1, 0, 0) are supplied to word selector WDSEL. As a result, the input data of the input ports B, C and D, which are the stored data of latches LB, LC and LD, are selected by word selector WDSEL and are output as output data 01, 02 and 03. These data correspond to the data which have been stored in latches LF, LG and LH before the clock is generated, i.e., the waveform data corresponding to waveform address RT+2.

Next, the shift operation of the first through third latches is executed by clock CK again, after which, data (0, 0) are respectively supplied to the input terminals B1 and B0 of full adder 205 and select signals (SFA, SFB, SFC)=(0, 0, 0) are supplied to word selector WDSEL. As a result, the input data of the input ports A, B and C, which are the stored data of latches LA, LB and LC, are selected by word selector WDSEL and are output as output data 01, 02 and 03. These data correspond to the data which have ever been stored in latches LE, LF and LG before the clock is generated, i.e., the waveform data corresponding to waveform address RT+3.

(2) The case where waveform address RT is defined as 4(N−1)+1

In this case, "1"s are supplied to the input terminals A0 and A1 of full adder 205 because (BS1, BS0)=(0, 1) as shown in FIG. 11. When the waveform data corresponding to waveform address RT is read out and is written in the second stage latch, data (1, 1) are respectively supplied to the input terminals B1 and B0 of full adder 205 and select signals (SFA, SFB, SFC)=(0, 1, 1) are supplied to word selector WDSEL. As a result, the input data of input port G, H and I, which are the stored data of latches LG, LH and LI, are output as the output data 01, 02 and 03, as shown in FIG. 11. It will be clearly understood that the data stored in these latches constitute the waveform data corresponding to the waveform address defined as 4(N−1)+1, based on the previously described relationship between the waveform address and the memory address.

Next, the shift operation of the first through third latches is executed by clock CK, after which, data (1, 0) are respectively supplied to the input terminals B1 and B0 of full adder 205. As a result, the stored data of latches LF, LG and LH, which constitute the waveform data corresponding to the waveform address RT+1, are output as the output data 01, 02 and 03.

Next, the shift operation of the first through third latches is executed again by clock CK, after which, data (0, 1) are respectively supplied to the input terminals B1 and B0 of full adder 205. As a result, the stored data of latches LE, LF and LG, which constitute the waveform data corresponding to the waveform address RT+2, are output as the output data 01, 02 and 03.

Next, the shift operation of the first through third latches is executed again by clock CK, after which, data (0, 0) are respectively supplied to the input terminals B1 and B0 of full adder 205. As a result, the stored data of latches LD, LE and LF, which constitute the waveform data corresponding to the waveform address RT+3, are output as the output data 01, 02 and 03.

The operations have been described with respect to the case of RT=4(N−1) and the case of RT=4(N−1)+1. When RT=4(N−1)+2 or RT=4(N−1)+3, the operations as same as the above cases are carried out in which the output data of the latches are selected according to the table as shown in FIG. 11 and the waveform data are generated based on the selected data. The musical tones are then generated based on the generated waveform data similar to the case of the regeneration of 16 bit-width waveform data.

What is claimed is:

1. An electronic musical instrument comprising:

a waveform memory for storing waveform data which is obtained by sequentially sampling musical tone waveforms, the waveform memory having a plurality of storage areas each of which is capable of storing a fixed number of bits, wherein if the length of the waveform data corresponding to a musical tone waveform is different from said fixed number of bits, the whole waveform data corresponding to the musical tone waveform is stored in the waveform memory so as not to generate vacant memory areas and the waveform data may be divided if necessary and the parts of the waveform data obtained by the division is stored in a plurality of neighboring storage areas of the waveform memory; and musical tone generating means for generating a desired musical tone, including reading means for repetitively reading out waveform data corresponding to a portion of a waveform;

determining means for determining the waveform data from the read out data based on the length of the waveform data of the desired musical tone; and tone generation means for generating the musical tone based on the determined waveform data.

2. An electronic musical instrument according to claim 1 wherein the waveform memory stores a full length waveform data, the length of which is equal to the fixed number of bits which can be stored in each storage area of the waveform memory, and a shorter length waveform data, the length of which is shorter than the length of the full length waveform data.

3. An electronic musical instrument according to claim 1 wherein said musical tone generating means comprises:

a waveform memory address generating circuit for sequentially generating waveform addresses which designate the waveform data to be generated;

a memory address generating circuit for sequentially generating memory addresses which designate the storage areas of the waveform memory in which the waveform data corresponding to the waveform addresses is stored;

a read out control circuit for reading out a predetermined number of data from the waveform memory based on the memory address currently generated; and a waveform data determining circuit for determining waveform data from the data read out from the waveform memory, said waveform data determining circuit comprising:

a shift register in which the predetermined number of data read out from the waveform memory is sequentially shifted; and a selector which selects the data stored in the shift register based on the waveform address currently generated and the length of the waveform data to be generated.

4. An electronic musical instrument according to claim 3 wherein the waveform memory stores a full length waveform data, the length of which is equal to the fixed number of bits which can be stored in each storage area of the waveform memory, and a shorter length waveform data, the length of which is shorter than the length of the full length waveform data.

5. An electronic musical instrument comprising:

a waveform mercury for storing waveform data which is obtained by sequentially sampling musical tone waveforms, the waveform memory having a plurality of storage areas each of which is capable of storing a fixed number of bits, wherein if the the length of the waveform data corresponding to a musical tone waveform is different from said fixed number of bits, the whole waveform data corresponding to the musical tone waveform is stored in the waveform memory so as not to generate vacant memory areas and the waveform data may be divided if necessary and the parts of the waveform data obtained the division is stored in a plurality of neighboring storage areas of the waveform memory, and wherein the waveform memory stores a full-length waveform data, the length of which is equal to the fixed number of bits which can be stored in each storage area of the waveform memory, and a shorter length waveform data, the length of which is shorter than the length of the full length waveform data;

musical tone generating means for reading out the data stored in the waveform memory corresponding to a desired musical tone to be generated, and for determining the waveform data from the read out data based on the length of the waveform data of the desired musical tone, and for generating the musical tone based on the determined waveform data, said musical tone generating means comprising:

a waveform memory address generating circuit for sequentially generating waveform addresses which designate the waveform data to be generated;

a memory address generating circuit for sequentially generating memory addresses which designate the storage areas of the waveform memory in which the waveform data corresponding to the waveform addresses is stored, wherein the memory address generating circuit generates the waveform address as the memory address when generating the musical tone of the full length waveform data, and the memory address generating circuit multiplies the waveform address by the ratio between the length of the shorter length waveform data and that of the full length waveform data and generating the multiplied result as the memory address when generating the musical tone of the shorter length waveform data;

a read out control circuit for reading out a predetermined number of data from the waveform memory based on the memory address currently generated; and a waveform data determining circuit for determining waveform data from the data read out from the waveform memory, said waveform data determining circuit comprising:

a shift register in which the predetermined number of data read out from the waveform memory are sequentially shifted; and a selector which selects the data stored in the shift register based on the waveform address currently generated and the length of the waveform data to be generated.

6. An electronic musical instrument comprising:

a waveform memory for storing waveform data which is obtained by sequentially sampling musical tone waveforms, the waveform memory having a plurality of storage areas each of which is capable of storing a fixed number of bits, wherein if the length of the waveform data corresponding to a musical tone waveform is different from said fixed number of bits, the whole waveform data corresponding to the musical tone waveform is stored in the waveform memory so as not to generate vacant memory areas and the waveform data may be divided if necessary and the parts of the waveform data obtained by the division is stored in a plurality of neighboring storage areas of the waveform memory;

address generation means for simultaneously generating a plurality of successive memory addresses storing waveform data;

readout means for reading out the data stored in the generated memory addresses, the data corresponding to a desired musical tone to be generated;

determining means for determining the waveform data from the read out data based on the length of the waveform data of the desired musical tone; and generation means for generating the musical tone based on the determined waveform data.

7. An electronic musical instrument comprising:

a waveform memory for storing waveform data which is obtained by sequentially sampling musical tone waveforms, the waveform memory having a plurality of storage areas each of which is capable of storing a fixed number of bits, wherein if the length of the waveform data corresponding to a musical tone waveform is different from the fixed number of bits, the whole waveform data corresponding to the musical tone waveform is stored in the waveform memory so as not to generate vacant memory areas and the waveform data may be divided if necessary and the parts of the waveform data obtained by the division is stored in a plurality of neighboring storage areas of the waveform memory; and waveform address generation means for generating a waveform address, for waveform data having a length shorter than the length of the storage area, by assigning a plurality of sequential numbers to each waveform data, beginning with a leading waveform data;

memory address generation means for generating a memory address by multiplying the generated waveform address by the ratio between the fixed number of bits and the length of the waveform data;

readout means for reading out the data stored in the waveform memory corresponding to e desired musical tone to be generated;

a waveform data determining circuit for determining waveform data from the data read out from the waveform memory; and tone generation means for generating the musical tone based on the determined waveform data.

* * * * *